United States Patent [19]

Blair et al.

[11] Patent Number: 4,649,575

[45] Date of Patent: Mar. 17, 1987

[54] TOILET SEAT COVER AND HEAT INSULATOR THEREFOR

[76] Inventors: David R. Blair; Kathy I. Blair, both of 1012 Hammet Hill Rd., Bowling Green, Ky. 42101

[21] Appl. No.: 859,917

[22] Filed: Apr. 5, 1986

[51] Int. Cl.[4] ..... A47K 13/14

[52] U.S. Cl. ..... 4/243; 4/242

[58] Field of Search ..... 4/234, 242, 243, 245, 4/246; 57/226, 225

[56] References Cited

U.S. PATENT DOCUMENTS

| | | | |
|---|---|---|---|
| 3,102,276 | 9/1963 | Warnberg | 4/242 |
| 3,166,885 | 1/1965 | Bridgeman et al. | 57/226 |
| 3,344,597 | 10/1967 | Petree | 57/226 X |
| 3,380,244 | 4/1968 | Martin | 57/226 |
| 3,517,396 | 6/1970 | Wert | 4/234 |
| 3,609,953 | 10/1971 | Kitawaza | 57/226 |
| 3,653,076 | 4/1972 | Warnberg | 4/242 |
| 4,227,267 | 10/1980 | Robertson | 4/234 |
| 4,586,202 | 5/1986 | Uchida | 4/242 |

FOREIGN PATENT DOCUMENTS

| | | | |
|---|---|---|---|
| 0153684 | 9/1985 | European Pat. Off. | 4/243 |
| 1382092 | 1/1975 | United Kingdom | 4/243 |

*Primary Examiner*—Henry K. Artis

*Attorney, Agent, or Firm*—Wells & Wells

[57] ABSTRACT

A toilet seat cover made from expanded polymer foam sheet material has an elastic tape secured to the curved edges of the cover with no tape secured to the rear flat edge. The cover is held on a toilet seat by the elastic curved edges.

7 Claims, 3 Drawing Figures

TOILET SEAT COVER AND HEAT INSULATOR THEREFOR

BACKGROUND OF THE INVENTION

The field of the invention is baths, closets, etc., and the invention is particularly concerned with covers for toilet seats.

The state of the art of toilet seat covers may be ascertained by reference to U.S. Pat. Nos. 3,102,276; 3,348,243; and 4,227,267, the disclosures of which are incorporated herein by reference.

It can be seen from the state of the art that toilet seat covers of paper and plastic have been provided for purposes of sanitation. An inexpensive toilet seat cover for the purpose of thermal insulation, however, has not been provided by the prior art. By personal experience the ordinary person knows the need for thermal insulation from cold toilet seats.

SUMMARY OF THE INVENTION

Having in mind the limitations of the prior art it is an object of the present invention to provide a toilet seat cover which provides thermal insulation from cold toilet seats and acts as a toilet seat warmer.

Another object of the present invention is to provide a sanitary seat cover.

Yet another object of the present invention is to provide an inexpensive toilet seat cover.

These objects are achieved by a toilet seat cover of polyethylene foam having a thickness of ⅛th inch.

Because of the expanded polymer foam the toilet seat cover provides insulation from the coldness of the toilet seat and also provides some cushioning for comfort. The ⅛th inch thickness is thin enough to allow the toilet seat to be raised and stay without continuously falling back down and still serves adequate protection from the cold.

Around the outer edge of the cover, except for the back straight edge, there is a piece of polyester elastic 1¼ inches wide and 53½ inches long sewn to the edge. This is done in order to fasten the toilet seat warmer to the toilet seat. The elastic is 88% polyester and 12% rubber. The elastic is wrapped around both sides of the expanded polymer foam and can be sewn in a zig zag fashion. Nylon elastic thread comprising 38% nylon, 37% rubber, and 25% polyester is useful for sewing the elastic.

The toilet seat warmer is attached by streatching it over the outside of the toilet seat.

An inner oval circle is cut out and left plain.

The back straight edge overhang is tucked down between the back of the toilet seat and the hinges. The overhand is due to the excess of expanded polymer needed to make the back corners fit properly.

The toilet seat cover of the present invention has the advantages that:

1. It insulates from the cold;
2. It provides cushioning comfort;
3. It sheds water; and
4. It wipes clean easily.

BRIEF DESCRIPTION OF THE DRAWINGS

The present invention is best described by reference to the accompanying drawings, wherein.

DESCRIPTION OF THE PREFERRED EMBODIMENTS

Figure 1:
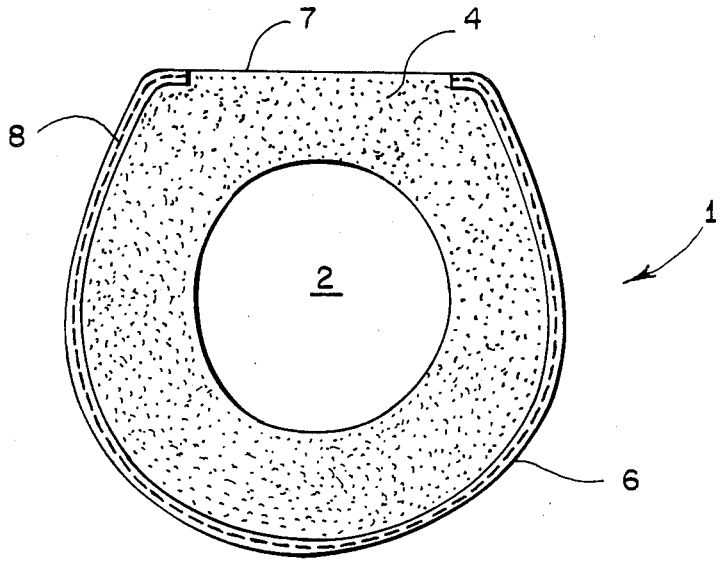
FIG. 1 is a top plan view of the toilet seat cover of the present invention.

With particular reference to FIG. 1, the seat cover 1 is shown in a top plan pattern view with a hole 2 cut out or died therefrom.

The seat cover is made from ⅛th inch polyethylene foam sheet material 4 and an elastic strip 6 is secured to the front and side edges in a continuous ribbon by stitching 8.

No elastic material is attached to the rear edge 7 of the pattern.

Figure 2:
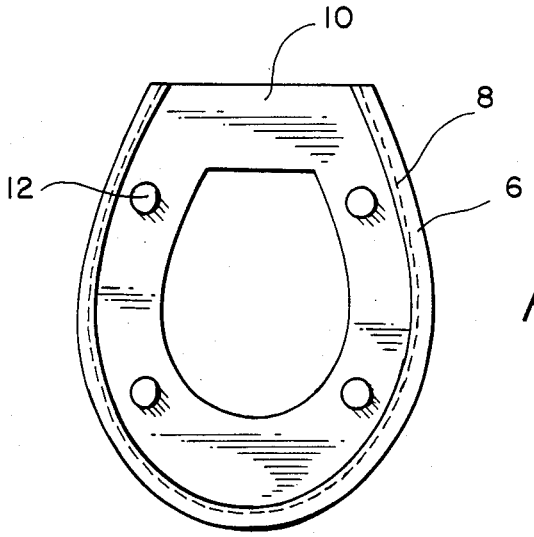
FIG. 2 is a bottom view of the cover mounted on a toilet seat.

In FIG. 2 it is seen that the seat cover is affixed to the seat by the gripping action of the elastic tape 7 on all edges save the rear edge of toilet seat 10. Toilet seat bumpers 12 are shown mounted on the bottom of toilet seat 10.

Figure 3:
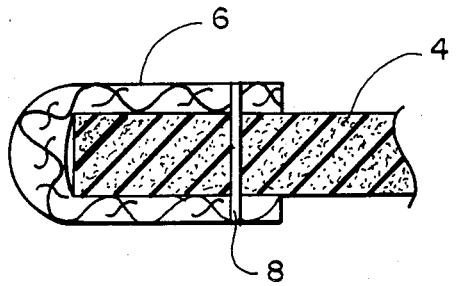
FIG. 3 is a detailed showing of the elastic material mounted on the outer edge of the toilet seat cover.

FIG. 3 shows in detail the elastic 6 overlapping the outer edge of seat cover 4 and secured by elastic thread 8.

The present invention is characterized by ease of installation in which the cover is mounted on a toilet seat by stretching the elastic taped edges over all sides of the toilet seat except the rear edge and then held in place in a wrinkle-free, comfortable fashion.

The expandable foam is easily cleaned and the whole seat cover is easily removed from the toilet seat and replaced.

Because of the low cost of materials the present seat cover can be used in hospitals as a throw-away item and for purposes of sanitation.

I claim:

1. A toilet seat cover for a toilet seat having a flat bottom side, a first hole in the middle, a first rear portion, a first flat edge on said first rear portion, first side and front portions having first curved edges, said toilet seat cover comprising:
   (a) expanded polymer foam sheet material with a top side and a bottom side having a second hole in the middle thereof, a second rear portion with a second flat edge and second side and front portions with second curved edges;
   (b) an elastic tape having a longitudinal dimension extending continuously along said second curved edges and having a width affixed to said top and bottom sides of said foam sheet; and
   (c) said toilet seat cover positioned by stretching over said first curved edges and said elastic tape positioned on said flat bottom side between said first curved edges and said first hole in the middle.

2. The toilet seat cover of claim 1, wherein said polymer foam is polyethylene foam.

3. The toilet seat cover of claim 1, wherein said polymer foam is ⅛th inch in thickness.

4. The toilet seat cover of claim 1, wherein said elastic tape is 88% polyester and 12% rubber.

5. The toilet seat cover of claim 4, wherein said elastic tape is about 1¼ inches wide and about 53½ inches long.

6. the toilet seat cover of claim 1, wherein said elastic tape is affixed by elastic thread sewn therethrough.

7. The toilet seat cover of claim 6, wherein said elastic thread is 38% nylon, 37% rubber, and 25% polyester.

* * * * *